United States Patent [19]

Okumoto

[11] Patent Number: 4,638,817

[45] Date of Patent: Jan. 27, 1987

[54] DEVICE FOR CONTROLLING CONTENTS OF TOBACCO ON CIGARETTE MACHINE

[75] Inventor: Yutaka Okumoto, Musashino, Japan

[73] Assignee: Japan Tobacco, Inc., Tokyo, Japan

[21] Appl. No.: 705,314

[22] Filed: Feb. 25, 1985

[30] Foreign Application Priority Data

May 8, 1984 [JP] Japan ..... 59-090257

[51] Int. Cl.[4] ..... A24C 5/14

[52] U.S. Cl. ..... 131/280; 131/84.1

[58] Field of Search ..... 131/905, 906, 280, 84.1

[56] References Cited

U.S. PATENT DOCUMENTS

| | | | |
|---|---|---|---|
| 3,604,429 | 9/1971 | De Witt | 131/906 |
| 3,604,430 | 9/1971 | Norwich et al. | 131/906 |
| 4,063,563 | 12/1977 | Corenzen | 131/906 |
| 4,574,816 | 3/1986 | Rudszinat | 131/905 |

*Primary Examiner*—V. Millin

*Attorney, Agent, or Firm*—Murray and Whisenhunt

[57] ABSTRACT

A tobacco content control device for cigarette machine, including a radiometric density detector for irradiating tobacco being transferred along a predetermined path on a cigarette machine with a radiant ray and converting the intensity of radiation transmitted through the tobacco into an electric signal, controlling tobacco contents to a predetermined value according to the output signal of the radiometric density detector, characterized in that the control device comprises: voltage generating means for producing two voltage signals indicative of upper and lower limits of a predetermined range; comparison means adapted to compare the output signal of the radiometric density detector with the voltage signals and to produce an output signal when the predetermined range is outrun; and means for informating abnormality of the radiometric density detector upon receipt of the output signal of the comparison means.

3 Claims, 5 Drawing Figures

DEVICE FOR CONTROLLING CONTENTS OF TOBACCO ON CIGARETTE MACHINE

BACKGROUND OF THE INVENTION

This invention relates to a device for controlling contents of tobacco on a cigarette manufacturing machine, and more particularly to a tobacco content control device which is capable of controlling tobacco contents constantly to a predetermined amount to guarantee production of cigarettes with uniform tobacco contents.

Reduction of production costs is a matter of utmost importance to manufacturers of cigarettes for increasing profits, and various efforts have been made to reduce such production costs.

One way of reducing production costs is to enhance the productivity of a cigarette machine. In this regard the technical developments have almost reached a stage where a single cigarette machine can produce as many as 8000 cigarettes per minute.

Another way of reducing production costs is to reduce the irregularities in tobacco contents of the individual cigarettes to be produced. Thus, in view of recent increases in leaf tobacco cost, vast profits can be made by slightly reducing the tobacco contents of the cigarettes. However unduly large reductions of the tobacco contents make it difficult to retain required quality. Accordingly, the approach generally taken in the production of cigarettes has been to measure the irregularities in weight of tobacco contents of cigarettes to check for deviations from a standard weight, and determining a target value by adding a proportional amount of tobacco to a minimum weight of tobacco which is acceptable to achieve the desired quality.

In other words, reduction of irregularities in the weight of the tobacco contents leads to minimization of the target value. This is why the cigarette manufacturers have been making great efforts to reduce irregularities in the weight of the tobacco contents of cigarettes.

In order to reduce irregularities in tobacco contents, it is important to keep a cigarette machine in good maintenance to preclude movements of worn-out mechanical parts. However, the best measure is to add a tobacco content control device of high quality to the cigarette manufacturing machine, and various devices have been proposed in this connection.

For example, Japanese Patent Appln. Pub. No. 38-18750 discloses a method of controlling the tobacco content on the basis of air permeability, utilizing correlation between the weight of a tobacco content and its air permeability. However, this method is influenced by variations in the suction pressure and the particle size composition of tobacco, which tend to disturb the pre-established correlation between the weight and air permeability of the tobacco content thereby, failing to reduce the irregularities in tobacco content to any significant degree.

U.S. Pat. Nos. 2,937,280 and 2,861,683 disclose electrostatic capacity methods based on correlation between a tobacco content and its electrostatic capacity. These methods are, however, susceptible to influences of moisture contents in the tobacco and temperature which bias the correlation between the tobacco content and electrostatic capacity. Accordingly, they hardly contribute to the reduction of irregularities in tobacco contents to any substantial degree, and have almost no practical application.

Another method for reducing irregularities in the weight of tobacco contents utilizes the correlation between a radiant ray, especially beta ray emitted from strontium 90, and the density of tobacco, controlling the tobacco contents on the basis of the transmission factor of the radiant ray. Since there is extremely reliable correlation between the transmissibility of a radiant ray and tobacco content, this method is employed by most of current cigarette manufacturing machines, in spite of such problems as safety in handling the radiant rays, and drifts and inferior response of an amplifier in a subsequent stage due to weakness of the output current of an ionization box which serves as a detection means.

The conventional tobacco content control device using a radiometric detector has a major defect, namely that, in case of a problem in a component part of the radiation detector, the measured value of transmissibility of a radiant ray which represents the tobacco content is varied irrespective of the actual tobacco content, and variations result in the tobacco contents of cigarettes to be produced. Although a radiometric detector must be handled more carefully than ordinary instruments, problem unavoidably occur with its component parts, including, for example, breakage of a foil of a metal such as titanium which is adhered to a portion where a cigarette is irradiated by an incident radiant ray, leakage of gas from an ionization box which converts the intensity of transmitted radiation into a variation in electric current, and drifts of an amplifier which amplifies the weak current output of the ionization box. These problem can take place either suddenly or gradually, so that it is necessary to check from time to time the average weight of the cigarettes being produced, i.e., the target value of the control. Normally, a suitable sample of cigarettes is weighed every ten minutes or so to guarantee a certain average weight. However, these operations are wasteful for a cigarette manufacturer and lower the labor productivity and which raises the production costs of the cigarettes.

SUMMARY OF THE INVENTION

It is therefore an object of the present invention to provide a tobacco content control device for a cigarette manufacturing machine, which device detects a problem in a radiometric density detector immediately and thereby prevents the production of cigarettes of defective quality.

In order to achieve the just-mentioned objective, the present invention provides a tobacco content control device for cigarette manufacturing machines. The device includes a radiometric density detection means for irradiating tobacco being transferred along a predetermined path on a cigarette machine with a radiant ray and converting the intensity of radiation transmitted through the tobacco into an electric signal, thereby controlling tobacco contents to a predetermined value according to the output signal of the radiometric density detection means. The control device comprises: voltage generating means for producing two voltage signals indicative of upper and lower limits of a predetermined range; comparison means for comparing the output signal of the radiometric density detection means with the voltage signals and to produce an output signal when the predetermined signal is outrun; and means for informing of an abnormality of the radiometric detection means in response to the output signal of the comparison means.

The above and other objects, features and advantages of the invention will become apparent from the following description and appended claims, taken in conjunction with the accompanying drawings which show by way of example some preferred embodiments of the invention.

DESCRIPTION OF PREFERRED EMBODIMENTS

Figure 1:
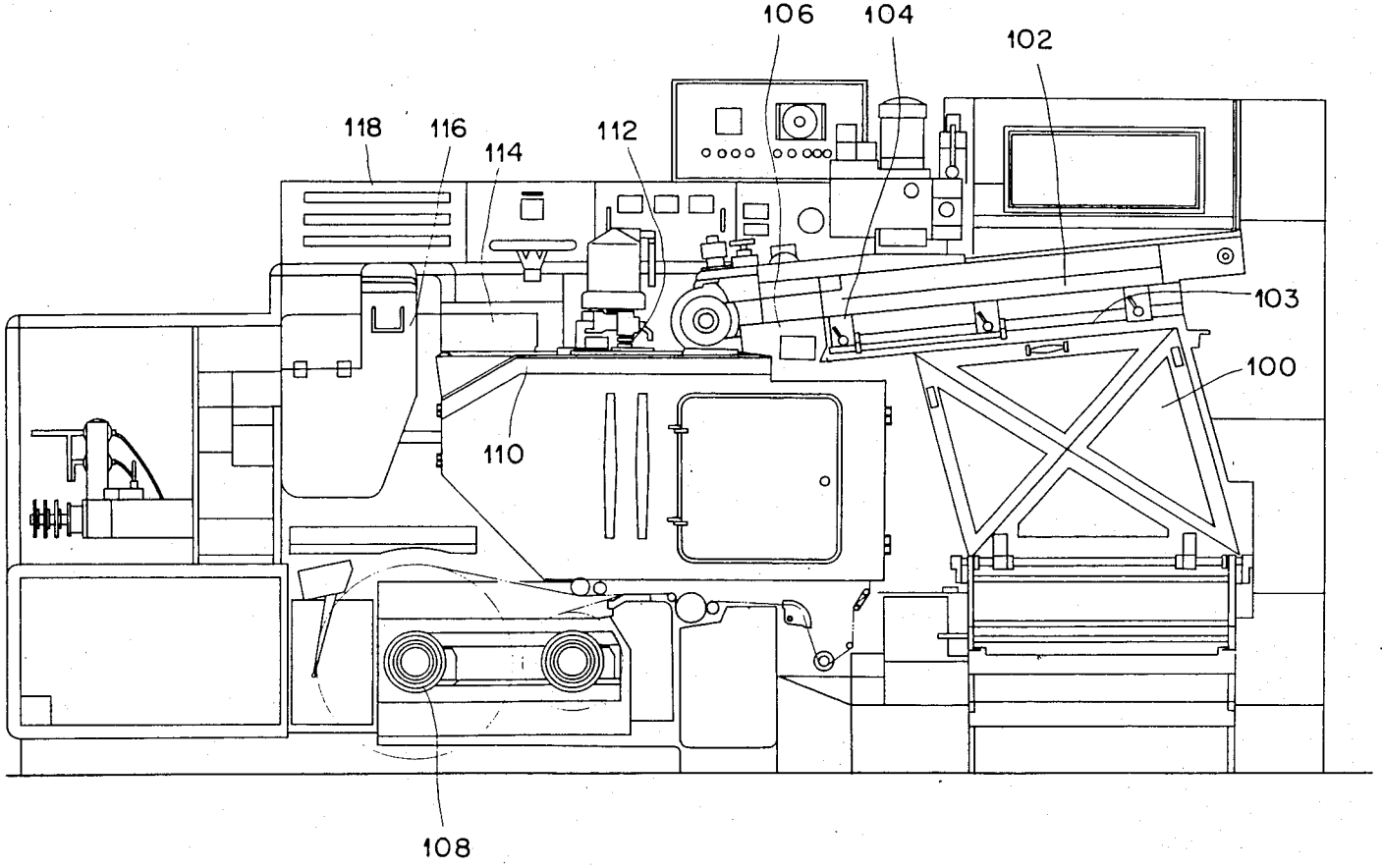
FIG. 1 is a schematic front view of a cigarette machine incorporating a tobacco content control device according to the present invention.

Referring to FIG. 1, there is schematically shown a cigarette machine employing a tobacco content control device embodying the present invention, wherein cut tobacco is sucked upward through a chimney 100 and adhered by suction to the lower side of a perforated cigarette conveyer 103 which is located beneath a suction chamber 102. The adhered tobacco layer is transferred to the left in the drawing toward a trimmer 104 which regulates the tobacco layer into a suitable thickness. The stratiform tobacco layer with a regulated thickness is passed through a first radiometric density detector 106 to measure its density, and then transferred onto and rolled in cigarette paper, which is fed from a paper roll 108 and stacked on a cloth tape 110. The cigarette paper is glued by a glue applicator 112 and the glued portions are dried by a heater 114 to form a stick-like cigarette. The thus formed stick-like cigarette is passed through a second radiometric density detector 116 to check its density and cut into cigarettes each of the unit length by a cutter 118. The cigarettes from the cutter are transferred to a tray by a conveyer (not shown).

Figure 2:
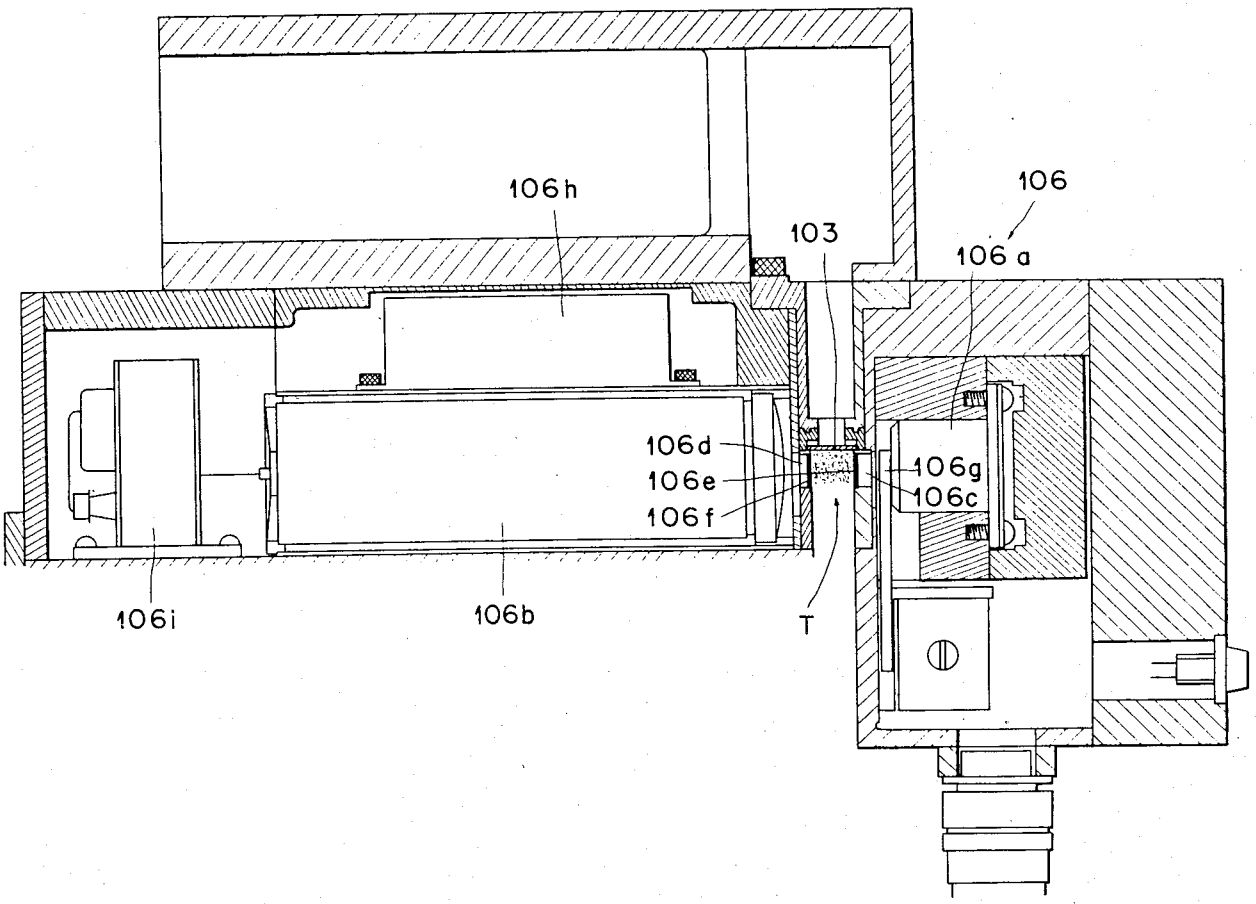
FIGS. 2 and 3 are enlarged sectional views showing part of the control device of FIG. 1.

Shown in FIG. 2 is the construction of the first radiometric density detector 106, including a radiation source **106*a* which emits a radiant ray, and an ionization box 106*b* which receives the radiant ray from the radiation source 106*a*. The radiation source 106*a* and ionization box 106*b* are located at a predetermined distance from each other and are confronted through aperture windows 106*c* and 106*d* which are formed in the respective casings. Thin metal films 106*e* and 106*f*, preferably consisting of titanium foils, are adhered to the aperture windows 106*c* and 106*d*. Provided between the thin metal films 106*e* and 106*f* is a channel for passing the trimmed tobacco T on the perforated conveyer 103. A shutter 106*g* is provided between the radiation source 106*a* and aperture window 106*c*** to prevent leakage of radiation.

With the foregoing construction, when the shutter **106*g* is open, the radiant ray emitted from the radiation source 106*a* is transmitted through the thin metal foil 106*e* of the aperture window 106*c* and the tobacco layer T and received by the ionization box 106*h* through the thin metal film 106*f* of the aperture window 106*d*. The outer periphery of the ionization box 106*b* is maintained at a high potential by a high voltage power supply 106*h*, so that a small current is supplied to an amplifier 106*i* when the tobacco layer T has a high density, and a large current is supplied when the tobacco density is low. Thus, the amplifier 106*i*** produces an output signal indicative of the density of the stratiform tobacco layer before rolling into the cigarette paper.

Figure 3:
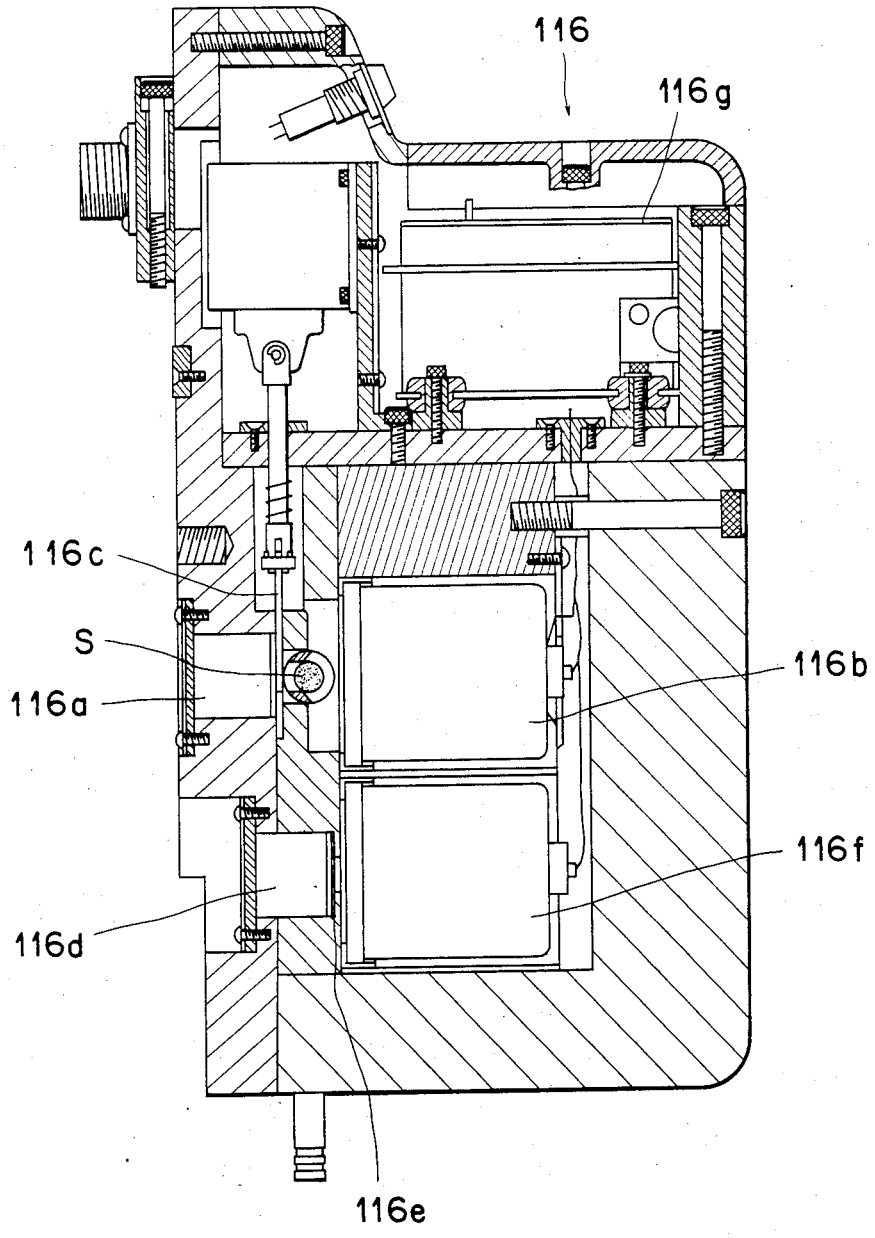

Illustrated in FIG. 3 is the construction of the second radiometric density detector 116 similar to that which is used on known cigarette machines as mentioned hereinbefore. The radiant ray emitted from a radiation source **116*a* is transmitted to an ionization box 116*b* through a stick-like cigarette S. The ionization current which is produced in the ionization box 116*b* is reduced by a drop in incident radiation when the stick-like cigarette S has a high density, and increased by an increase in incident radiation when the cigarette S has a low density. A shutter 116*c* is provided between the radiation source 116*a*** and cigarette S.

Another radiation source **116*d* is provided adjacent to the above-described radiation source 116*a*, the radiant ray from the radiation source 116*d* being transmitted to an ionization box 116*f* through a reference object 116*e* with a standard density to produce a reference ionization current in the ionization box 116*f*. Normally, negative and positive voltages are applied to the ionization boxes 116*b* and 116*f*, respectively, so that the output of the amplifier 116*g* which is applied with the ionization currents of the two ionization boxes 116*b* and 116*f* becomes zero when the stick-like cigarette S has a standard density. That is to say, the output of the amplifier 116*g* becomes negative or positive depending upon the density of the stick-like cigarette S. Accordingly, the amplifier 116*g*** produces an output signal corresponding to a deviation in density of the stick-like cigarette S from the standard density.

Figure 4:
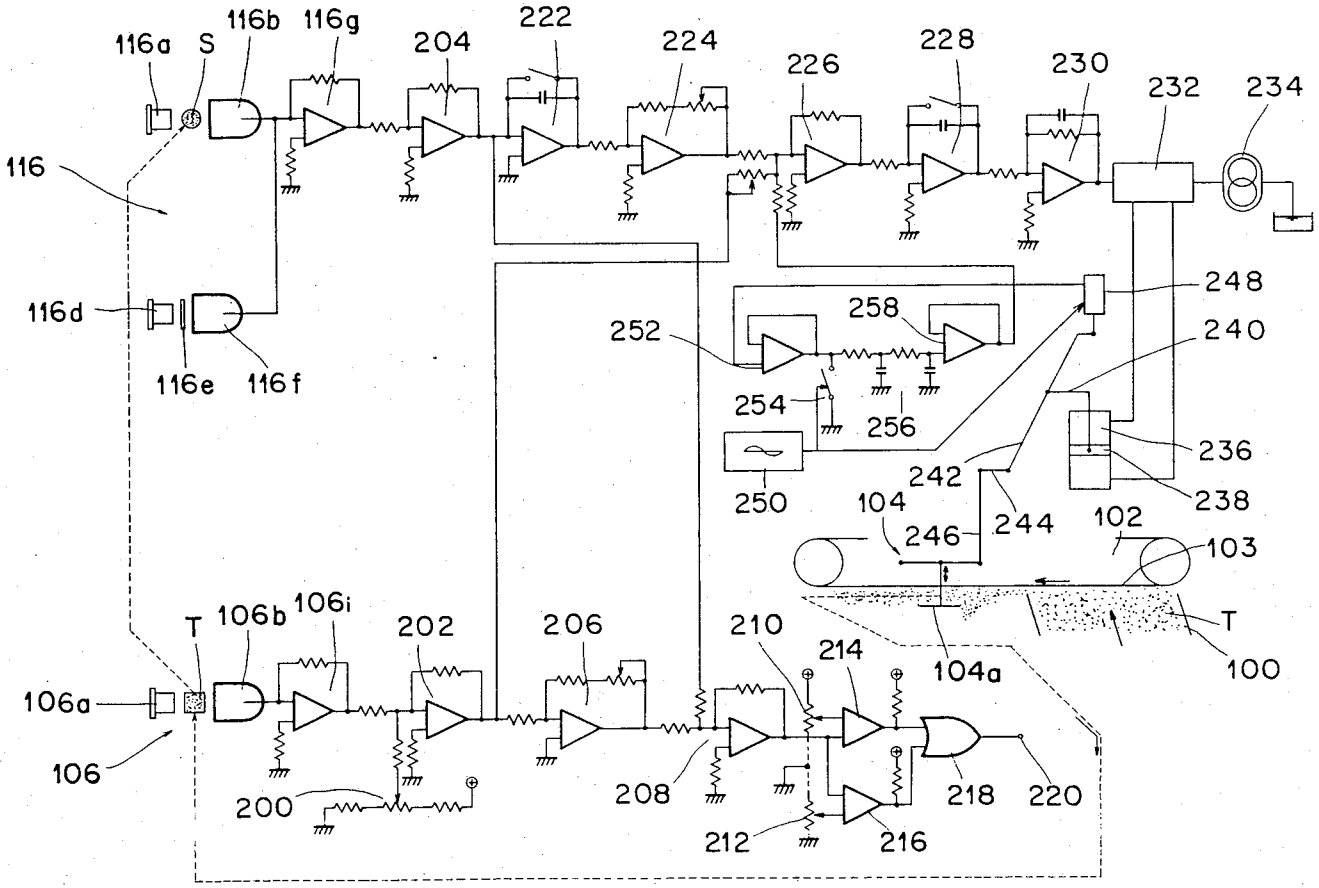
FIG. 4 is an electric circuit diagram of the control device according to the invention.

Shown in FIG. 4 is a control circuit for the device of the invention, in which the component parts common to FIGS. 1 to 3 are designated by like reference characters.

As described hereinbefore in connection with FIG. 1, the tobacco T is sucked upwardly through the chimney 100 and adhered in a stratiform on the lower side of the perforated cigarette conveyer 103 which is located beneath the suction chamber 102. The tobacco T is transferred in the arrowed direction toward the trimmer 104 where excessive tobacco is shaved off by a trimming disc **104*a*. Thereafter, the tobacco is passed through the first radiometric density detector 106 as indicated by broken line to measure its density. Thus, as described hereinbefore in connection with FIG. 5, the radiant ray from the radiation source 106*a* is transmitted to the ionization box 106*b* through the tobacco T, and the ionization box 106*b* which is applied with a high voltage produces a weak ionization current as its output. This weak current is amplified by the amplifier 106*i* and, after addition of a standard signal from a standard signal generator 200, is amplified again by an amplifier 202. The signal which is produced at the output terminal of the amplifier 202 is a voltage signal of a polarity and a level corresponding to the deviation of the actually measured density from the standard density. Thereafter, the tobacco T is rolled in cigarette paper and glue is applied to the paper to form a stick-like cigarette S. This stick-like cigarette S is then passed through the second radiometric density detector 116**.

As described hereinbefore with reference to FIG. 3, the radiant ray which is emitted from the radiation source 116*a* of the detector 116 is transmitted to the ionization box 106*b* through the stick-like cigarette S. On the other hand, a radiant ray from another radiation source 116*d* is transmitted to the ionization box 106*f* through a reference object 116*e* with a standard density. Since voltages of opposite polarities are applied to the ionization boxes 106*b* and 106*f*, a voltage signal of a polarity and a level corresponding to the deviation of the actually measured density of the stick-like cigarette S from the standard density appears at the output terminal of the amplifier 116*g*. This output signal of the amplifier 116*g* is amplified by the amplifier 204.

In this manner, the deviations in density of the stick-like cigarette S and the stratiform tobacco T are indicated by the output signals of the amplifiers 204 and 202, respectively. These two output signals should be basically the same but a slight difference occurs since fine tobacco shreds are sucked into the suction chamber 102 through the holes in the perforated conveyer 103 after the cut tobacco T leaves the first density detector 106.

For the purpose of obtaining the difference from the output 202, the output of the amplifier 204 is applied to an amplifier 208 which is also supplied with the output of the amplifier 202 after inversion through an amplifier 206. Thus, the amplifier 208 produces at its output terminal a signal proportional to the difference between the output signals of the first and second radiometric density detectors 106 and 116. If this signal is in a range between the preset voltage values from the voltage generators 210 and 212, comparators 214 and 216 both produce an output signal of low level, and, if not, one of the comparators 214 and 216 produces an output of high level and a signal of high level appears at the output terminal of an OR gate 218.

The output signal of the OR gate which indicates an abnormal difference between the two radiometric density detectors can be used for stopping the operation of the machine or to actuate an indicator. Accordingly, it becomes possible to guarantee an appropriate tobacco content for all of the cigarettes to be produced, and to prevent shipment of defective products which is detrimental to a cigarette manufacturer.

By an adder 226, the output of the amplifier 202 which represents the measured value of the first radiometric density detector 106 is added as a first signal to a second signal which is produced by integrating at an integrator 224 the output signal of the amplifier 204 which represents the measured value of the second radiometric density detector 116 followed by gain control through an amplifier 224.

The output of the adder 226 is integrated by an integrator 228 and then amplified by an amplifier 230 before supply to an electrohydraulic servo valve 232. The electrohydraulic servo valve 232 selectively supplies the pressurized oil from a gear pump 234 to the upper and lower chambers of a cylinder 236 according to the applied voltage, thereby displacing a piston 238 upward or downward within the cylinder 236. The upward or downward movement of the piston 238 is transmitted to the trimming disc 104*a* of the trimmer 104 through a link 240, shaft 242, link 244 and connecting rod 246, to move the trimming disc 104*a* upward or downward.

The position of the trimming disc 104*a* is detected by a differential transformer 248, which is applied with a signal of several kHz from an oscillator 250 and has its center core connected to the piston 238 through the shaft 242 and like 240. Therefore, in response to the upward and downward movements of the piston 238, a corresponding signal appears at the output terminal of the differential transformer 248, and this signal is amplified by an amplifier 252. Half-wave portions of the output of the amplifier 252 are dropped off to earth by a switch 254 which is operated by the output signal of an amplifier 250, and the remaining half-wave portions are flattened by a low pass filter 256, followed by DC amplification by an amplifier 258. The output of this amplifier 258 is applied to the adder 226 as a third input signal.

With the foregoing arrangement, when the sum of the first and second input signals of the adder 226 is positive, that is to say, when the tobacco content is deficient, a voltage appears at the output terminal of the adder 226, gradually increasing the output of the integrator 228 in a negative direction. As a result, the output of the amplifier 230 is increased in a positive direction, so that the electrohydraulic servo valve 232 slowly changes the flow of oil to push up the piston 238, lowering the trimming disc 104*a* through the link 240, shaft 242, link 244 and connecting rod 246 to increase the tobacco content. Simultaneously, the third input signal of the adder 226 is increased by the output signal of the differential transformer 248. Accordingly, the trimming disc 104*a* is lowered until the third input signal becomes equal to the sum of the first and second input signals. In case the tobacco content is excessive, the polarity in the foregoing operation is inverted. The speed of operation can be varied by changing the integration speed of the integrator 228, and the extent of movement can be adjusted by altering the gain of the amplifier 230.

Thus, the second signal which concerns the radiometric density detector 116 is a signal which is obtained by integrating the density signal by the integrator 222. On the other hand, the first signal which concerns the radiometric density detector 106 is a signal proportional to the density signal. Accordingly, when there is a difference between the first and second signals, the first signal may be dominant during a short time period, but the second signal is gradually increased by integration to a value which overwhelms the first signal. Therefore, the tobacco content is determined and controlled according to the first signal with respect to variations of a short period and according to the second signal with respect to variations of a long period.

Figure 5:
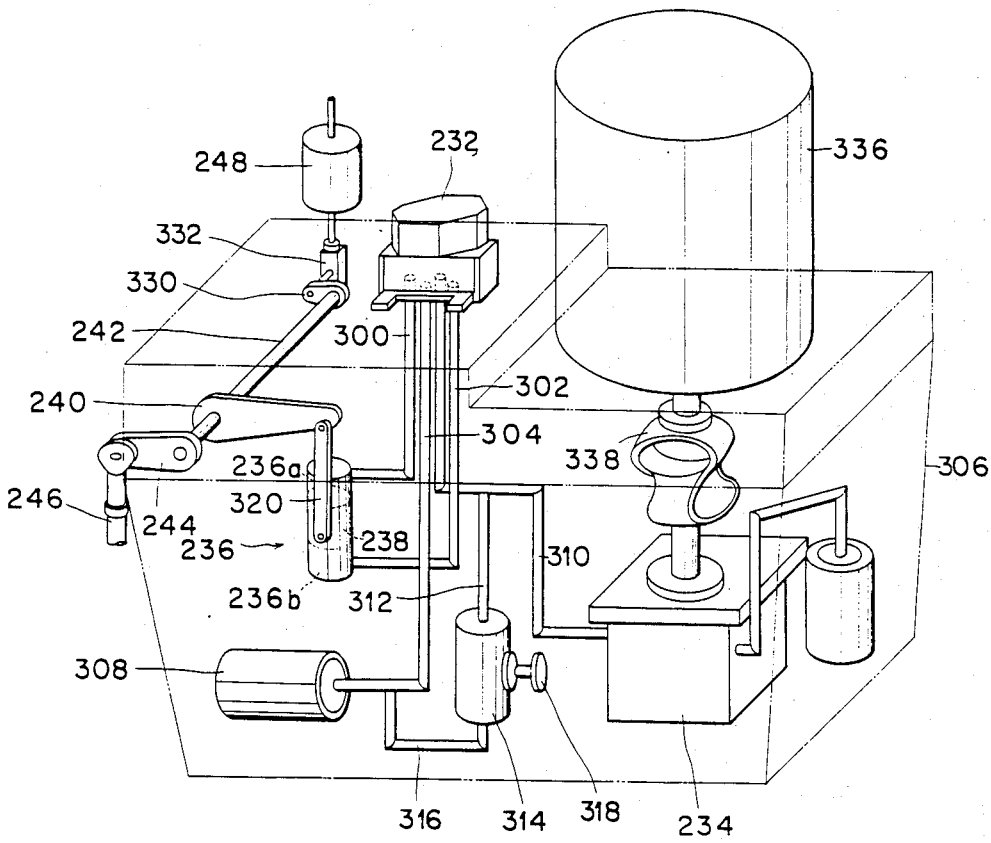
FIG. 5 is a schematic perspective view showing in detail other components of the control device of FIG. 1.

Illustrated in FIG. 5 is a drive mechanism for the trimming disc 104*a*, wherein the piston 238 is slidable up and down in the cylinder 236 which is fixedly mounted on an outer casing. The piston 238 is pushed down when pressurized oil is introduced into a cylinder chamber 236*a* through a pipe 300. At this time, the oil in the cylinder chamber 236*b* on the opposite side of the piston 238 is drained into a tank through a return pipe 304. Similarly, when pressurized oil is introduced into the cylinder chamber 236*b* to push up the piston 238, the oil in the opposite cylinder chamber 236*a* is drained into the tank through the return pipe 304. A filter 308 is provided at the outlet end of the return pipe 304.

The above-described hydraulic system is maintained at a preset oil pressure. In case an oil pressure exceeding the preset pressure level is applied by the gear pump, it is drained to the tank through a pipe 312 branched from a pipe 310 leading from the gear pump 234 to the electrohydraulic servo valve 232 and the filter 308, by operation of a relief valve 314. The pressure in the hydraulic system is preset by adjustment through a pressure adjusting screw 318.

The upward and downward movements of the piston 238 are picked up by a connecting rod 320 which is pivotally connected to the piston 238. The other end of the connecting rod 320 is pivotally connected to a link 240, so that upward and downward movement of the piston 238 cause the link 240 to rock up and down along with the shaft 242. The link 240 is securely fixed to the shaft 242 which is pivotally supported on the outer casing 306. The rocking movement which is transmitted to the shaft 242 through a link 244 which is fixed to the end of the shaft 242 to move vertically up and down a connecting shaft 236 which is pivotally supported at the other end of the arm. The trimming disc 104*a* is moved up and down by the upward and downward movements of the connecting shaft 246.

Secured to the other end of the shaft 242 is a link 330 which is rockable upon rotation of the shaft 242. Attached to the link 330 is a link 332 which is moved up and down by upward and downward rocking movements of the link 330. The link 332 is fixed to a center core of the differential transformer 248 to move the core up and down along with the link 332.

For instance, the differential transformer 248 is adapted to produce a positive voltage when the core is moved upward and a negative voltage when the core is moved downward, in proportion to the distance of movement. In the particular embodiment shown, the differential transformer 248 is arranged to produce a positive voltage when the connecting shaft 246 is moved upward and a negative voltage when moved downward.

The reference numeral 336 denotes a motor which is connected to the gear pump 234 through a universal joint 338.

Although the foregoing embodiment is arranged to check whether or not the difference between the first and second radiometric density detectors 106 and 116 is within a predetermined range, it is also possible to apply the same operation to the output of each detector.

As is clear from the foregoing description, the tobacco content control device of the invention is arranged to detect problems associated with a radiometric density detector by detecting outrun of the output signal of the density detector from a predetermined range. Therefore, it becomes possible to stop the cigarette machine automatically when the radiometric density detector fails to measure the density of tobacco contents correctly due to a particular problem thereby avoiding the undesirable situation where an enormous amount of defective cigarettes is produced, without necessitating frequent periodic sampling of cigarettes by an operator.

What is claimed is:

1. A tobacco content control device for a cigarette making machine wherein tobacco is transferred along a predetermined path in said cigarette making machine, said tobacco content control device comprising:

a radiometricdensity detector including first and second density detectors provided along said predetermined path to obtain two electric signals representative of tobacco density;

control means connected to said first and second density detectors for maintaining a flow rate of the tobacco at a predetermined level in accordance with said electric signals;

subtractor means connected to said first and second density detectors for obtaining a difference between said two electric signals;

voltage generating means provided independently of said control means and said subtractor means for producing two voltage signals set at two predetermined range;

comparison means connected to said subtractor means and said voltage generating means for comparing said difference between the two electric signals with said two voltage signals to produce an output signal when said predetermined range is outrun;

alarm means connected to said comparison means for informing of an abnormality of said radiometric density detector upon receipt of said output signal of said comparison means.

2. A tobacco content control device according to claim 1, and further comprising a standard voltage generator for producing a standard voltage signal to be added to a said output signal of said radiometric density detector to determine the deviation of an actually measured density from a preset standard value, said comparison means producing an output signal when said deviation outruns said predetermined range.

3. A tobacco content control device according to claim 1, wherein said first and second density detectors are of radiometric type for irradiating tobacco travelling along the predetermined path and measuring intensities of radiation passed through said tobacco and converting said intensities of radiation into said two electric signals.

* * * * *